United States Patent [19]

Richland

[11] Patent Number: 5,073,066

[45] Date of Patent: Dec. 17, 1991

[54] WALL RETAINING AND SCAFFOLDING ASSEMBLY FOR GROUND EXCAVATION AND METHOD FOR DISMANTLING SAME

[76] Inventor: Pierre Richland, 720, Montée des Bouleaux, L'Acadie, Québec, Canada, J0J 1H0

[21] Appl. No.: 570,317

[22] Filed: Aug. 21, 1990

[51] Int. Cl.[5] ..... E02D 3/02

[52] U.S. Cl. ..... 405/279; 405/277; 405/282

[58] Field of Search ..... 405/282, 272, 273, 274, 405/277, 279, 284, 285

[56] References Cited

U.S. PATENT DOCUMENTS

| | | | |
|---|---|---|---|
| 841,773 | 1/1907 | Fitzerald | 405/282 |
| 3,381,483 | 5/1968 | Huthsing, Jr. | 405/285 X |
| 3,971,223 | 7/1976 | Elkuch | 405/264 |
| 4,019,328 | 4/1977 | Koehl | 405/282 |
| 4,114,383 | 9/1978 | Nieber | 405/282 |
| 4,145,891 | 3/1979 | Krings | 405/282 |
| 4,372,709 | 2/1983 | Krings | 405/282 |
| 4,453,863 | 6/1984 | Sutton et al. | 405/282 |
| 4,472,090 | 9/1984 | Krings | 405/282 X |
| 4,657,442 | 4/1987 | Krings | 405/282 |
| 4,787,781 | 11/1988 | Bradberry | 405/282 |

*Primary Examiner*—Randolph A. Reese
*Assistant Examiner*—J. Russell McBee
*Attorney, Agent, or Firm*—Pierre Lesperance

[57] ABSTRACT

An excavation wall retaining assembly for use during repairs of damaged, earth ground-embedded fluid pipes, comprising: a first series of lowermost walls, vertically installed at the periphery of the lower section of an excavation made in the ground about the fluid pipes; feet releasably supporting the first series of walls spacedly above the flooring defined by the excavation; at least a second series of upper walls, vertically installed edgewisely over the first series of walls, supportingly by the latter. Jacks provide releasable, adjustable, compressive biasing forces against the walls so as to retain the latter in vertical position against caving in of surrounding earth. The wall retaining assembly is dismantleable and all of its structural elements are fully retrievable after use, from the bottom up or from top to bottom.

9 Claims, 5 Drawing Sheets

WALL RETAINING AND SCAFFOLDING ASSEMBLY FOR GROUND EXCAVATION AND METHOD FOR DISMANTLING SAME

FIELD OF THE INVENTION

This invention relates to wall assemblies to temporarily maintain the shape of a ground trench, ditch or the like excavation into which workers are to work, e.g. to repair damaged ground utility pipes passing therethrough.

BACKGROUND OF THE INVENTION

U.S. Pat. No. 4,019,328 to Jean Marie Gérard Koehl, shows that it is known to use cross-sectionally I or H-shape beams as the structural frame of a wall support assembly for excavations such as trenches or ditches. It is also known to use wooden planks retainingly slidingly engaged into the U-shape channels of the I-beams frame, to retain the earth wall of the excavation: see U.S. Pat. No. 841,773 to Albert Fitzgerald. This latter patent also shows adjustable, elongated jack members extending transversely through an excavation, for applying compressing forces against a wall support assembly in an excavation, to bias the latter outwardly against the earth wall to prevent caving in. Fitzgerald also shows enlarged support plates at the ends of the jack members.

However, a major disadvantage of the known wall support assemblies is that the structural elements thereof usually have to be left in place in the excavation after use: they are unretrievable. This means that the whole capital cost of the wall support assembly is added to the workers' time in the computation of the overall cost for repairs in the excavation—a wasteful inefficiency. Moreover, it requires know-how to install in a proper way the wall support assemblies, while preventing any hazard to the workers installing the wall assembly, e.g. landslide while the workers are located into the excavation.

OBJECTS OF THE INVENTION

The main object of the invention is thus to provide a wall support assembly for ground excavations including trenches, ditches and the like, which will be very easy to install or dismantle.

A further object of the invention is to provide such a wall support assembly, which will enable the retrieving of all structural elements after use, for substantially increased cost-effectiveness.

SUMMARY OF THE INVENTION

Accordingly with the objects of the invention, there is disclosed an excavation wall retaining assembly for use during repairs of damaged, earth ground-embedded fluid pipes, said wall retaining assembly comprising: (a) a first series of lowermost wall members, vertically installed at the periphery of the lower section of an excavation made in the ground about said fluid pipes; (b) base members, releasably supporting said first series of wall members spacedly above the flooring defined by said excavation; (c) at least a second series of upper wall members, vertically installed edgewisely over said first series of wall members, supportingly by the latter; wherein some sections of said first or second wall members have apertures for through passage of said fluid pipes transversely of said excavation; (d) securing means, releasably anchoring said lowermost wall members edgewisely to said second series of wall members; and (e) biasing means, providing releasable, adjustable, compressive biasing force against said wall members so as to retain the latter in vertical position against caving in of surrounding ground earth; wherein said wall retaining assembly is dismanteable and all of its structural elements are fully retrievable after use.

DETAILED DESCRIPTION OF THE INVENTION

Figure 1:
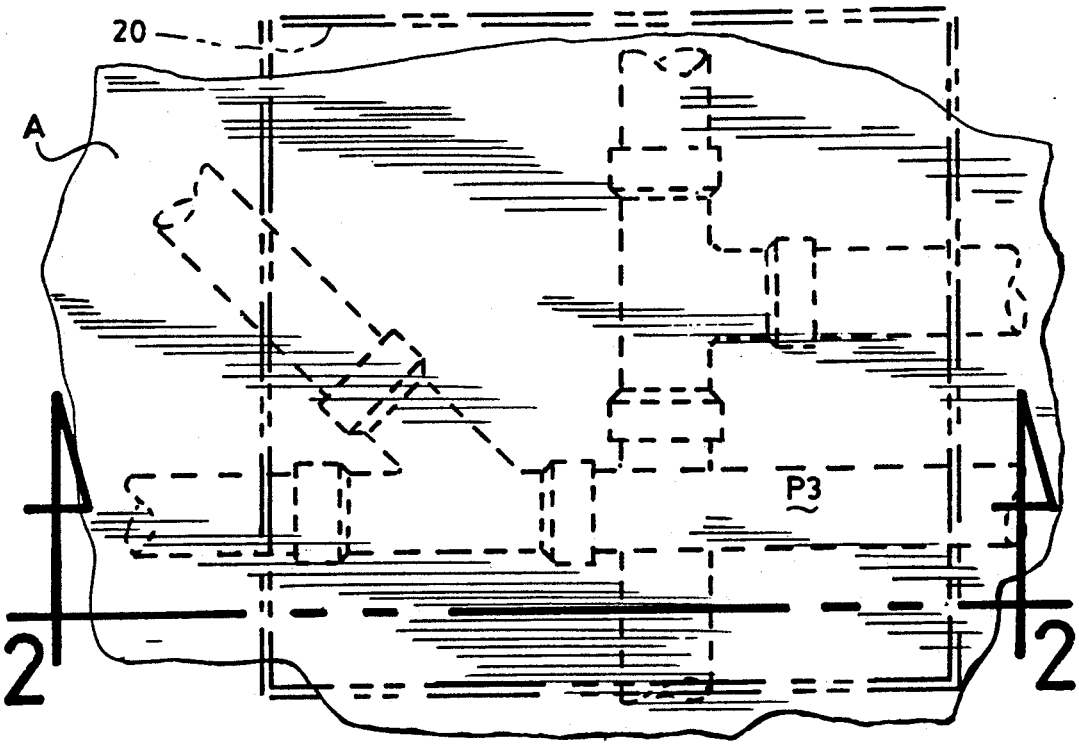
FIG. 1 is a top plan view of a road pavement, showing in phantom lines a network of ground-embedded fluid pipes.
Figure 2:
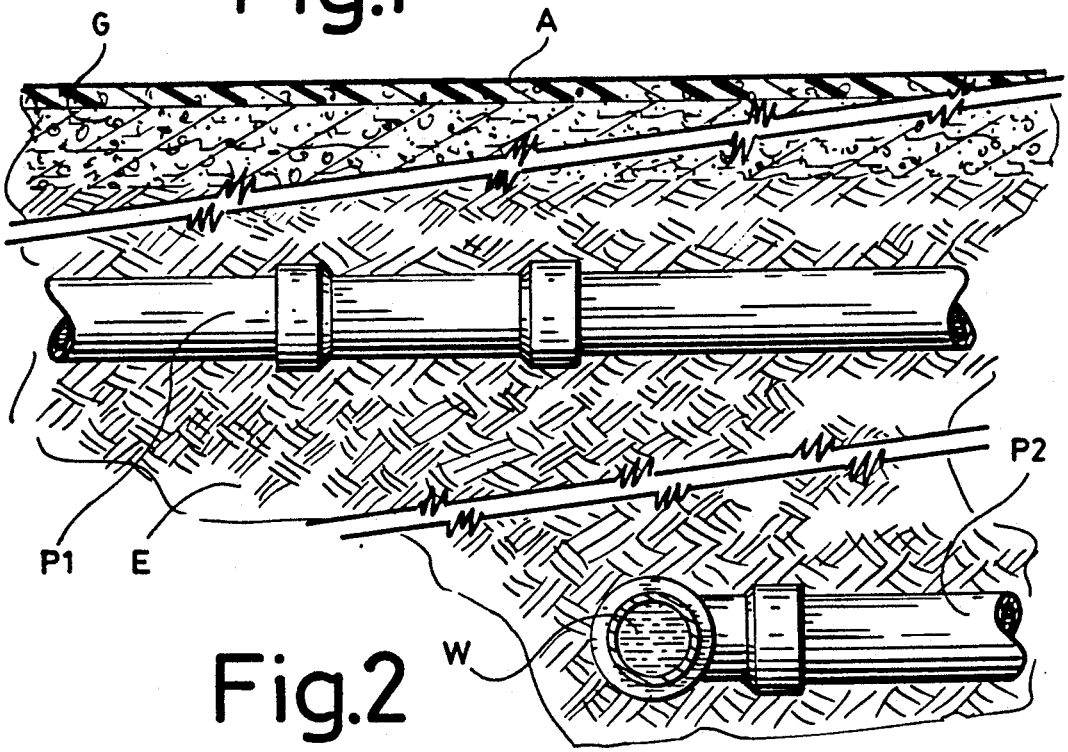
FIG. 2 is a vertical sectional view of the ground, taken along line 2—2 of FIG. 1.

As can be seen in FIGS. 1–2, a network of utility pipes $P_1$, $P_2$, conventionally extend in a modern city horizontally through ground or earth E, below asphalt pavement A and its supporting gravel layer G. These pipes may carry for example water W. Elbowed portions of the pipes $P_1$, $P_2$, are prone to break or be damaged more often than the straight portions thereof, and thus, means must be devised to reach these areas in the ground and to enable a worker to effect the repairs. This is done by digging through pavement A, gravel G and earth E, in register with one or more broken pipe sections $P_3$, so as to define an excavated area 20 which may be for example of cubic shape. Hence, pipe section $P_3$ extends freely horizontally through excavation 20, being endwisely anchoringly embedded into the earth E. Excavation 20 defines a floor 22, four side walls 24, and a top mouth 26 coplanar to asphalt A.

Figure 2A:
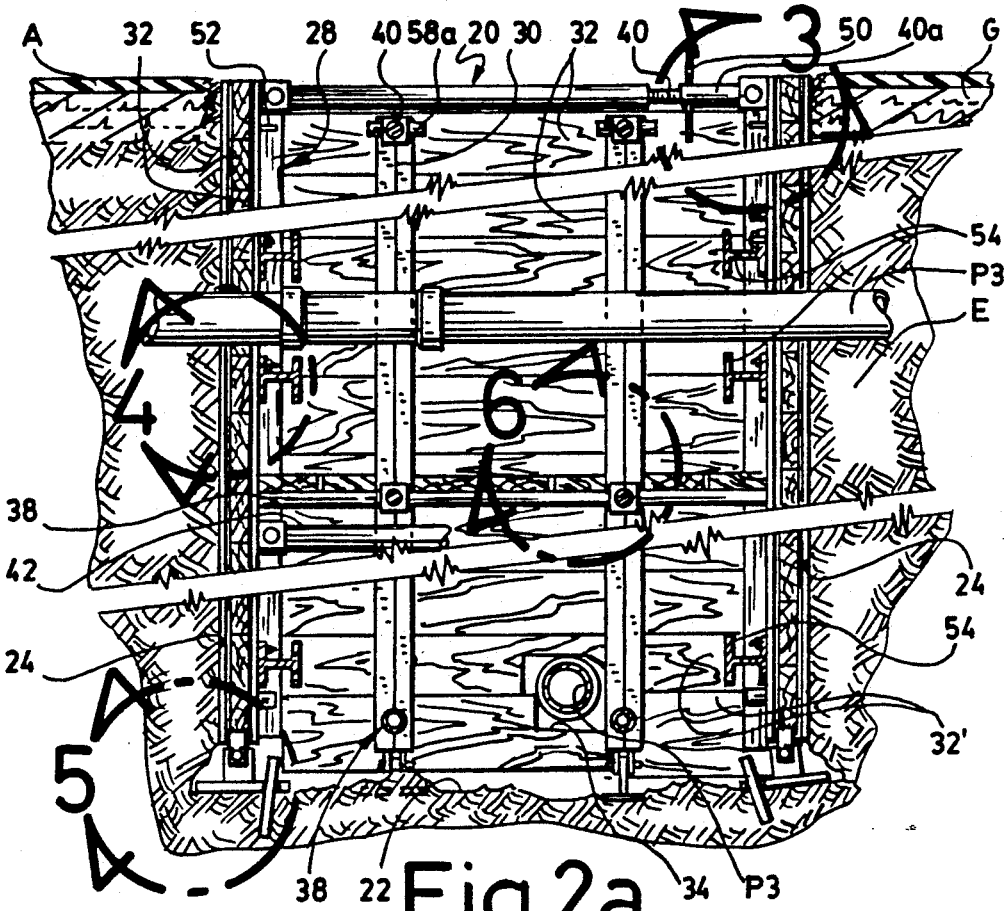
FIG. 2*a* is a view similar to that of FIG. 2, but with an excavation having been dug along the broken lines 2*a*—2*a* of FIG. 1, and further illustrating a partly broken excavation wall retaining and scaffolding system according to the invention.
Figure 10:
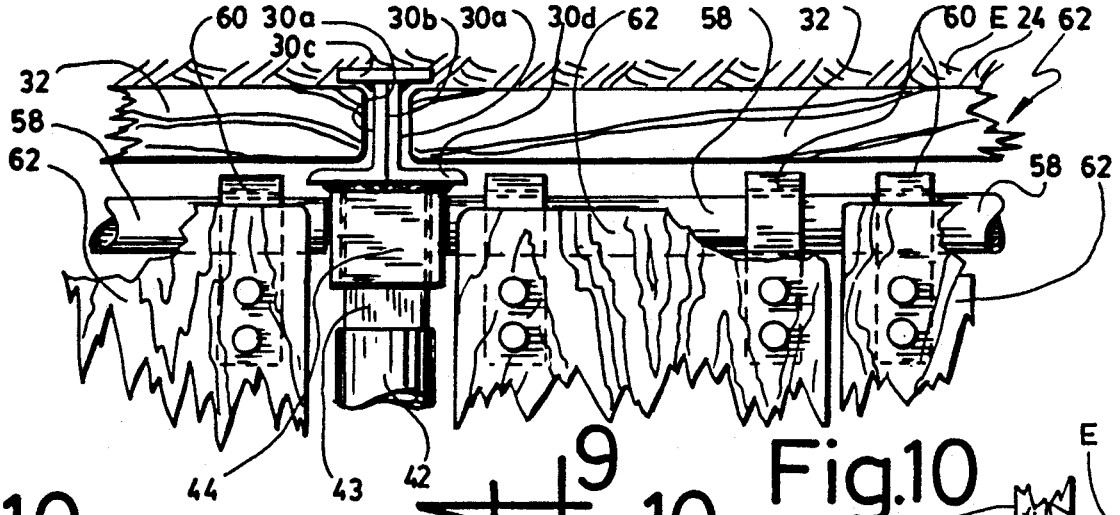
FIGS. 9–10 are cross-sectional views along lines 9—9 and 10—10 respectively of FIG. 6.

To maintain the cubic shape of the excavation 20, a supporting wall assembly 28 needs to be installed, at least for the time required by the workers to effect the repairs to the damaged pipe section $P_3$. Wall assembly 28 includes a series of spaced, vertically extending, rigid beams or post sections 30, of I shape in cross-section and aligned in end-to-end relation. I-beams or post sections 30 are applied spacedly against each of the four walls or faces 24 of excavation 20, as illustrated in FIG. 2*a*, wherein a pair of opposite channels 30*a* of U-shape cross-section are defined for each postsection 30 (FIG. 10). Each portion 30 has a web 30*b*, an outer flange 30*c*, and an inner flange 30*d*. Outer flange 30*c* is applied flat against excavation face 24. A number of sheeting planks 32 of same length extend horizontally between each successive pair of post sections 30 on a same excavation wall 24, in superimposed fashion, so as to endwisely engage into the channels 30*a* of these two supporting post sections. Accordingly, a wall of horizontal planks 32 is defined. Obviously, openings 34 will be made through some sections of planks 32', to allow through-passage of the damaged pipes $P_3$ to be repaired for access by the workers in the excavation 20.

Figure 11:
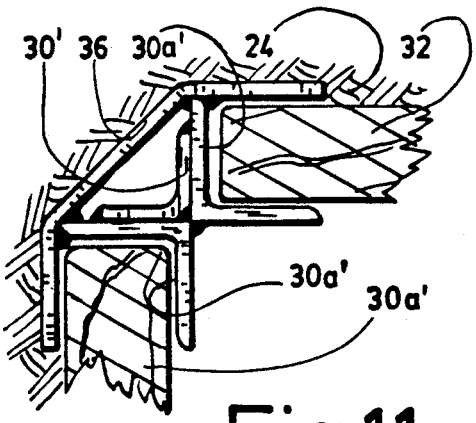
FIG. 11 is a top plan view of a corner portion of the excavation and associated supporting wall assembly, at an enlarged view relative to FIG. 2*a;*
Figure 12:
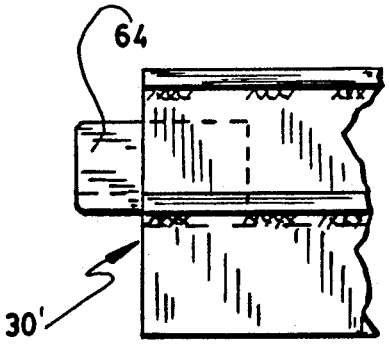
FIG. 12 is a side elevational view of the elements of FIG. 11.
Figure 13:
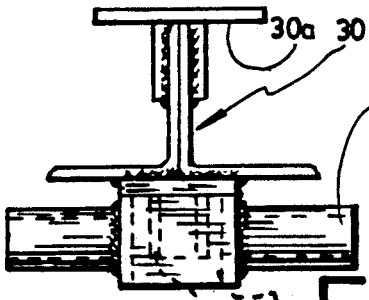
FIG. 13 is an isolated view of one wall frame element of FIG. 10.

In each corner of the wall of planks 32, as shown in FIGS. 11–12, a modified beam 30' is provided, wherein its two U-shape channels 30*a'* are at right angle to each other rather than at 180° as with I-beam 30. Such a beam 30' could be as illustrated in FIG. 11, being of generally + shape in cross-section and further including an integral outer truss panel 36 bent at right angle in three straight segments in 45° increments, panel 36 joining the two U-shape channels 30*a'*.

Vertical beams 30 on opposite walls 24 should be in respective registering pairs. To prevent the earth wall 24 and thus wooden planks 32 from caving in with time and filling excavation 20, elongated jack members 38 are required to each spacedly engage against a pair of opposite beams 30, in horizontal position above the floor 22 of the excavation 20. One jack member 38 is shown in broken view in FIG. 3. Jack member 38 includes a threaded rod 40, threadedly axially engaged into the inwardly-threaded end 42*a* of an elongated tubular casing 42. The diametrically enlarged untreaded outer end section 40*a* of rod 40 is partly freely engaged into a rigid cross-sectionally quadrangular socket 44, which is anchored to and protrudes from the top end of each 30. From the end of each rod end section 40*a* protrudes a diametrally smaller cylindrical extension 46 having a conical tip 46*a*. Rod extension 46 extends through a rigid annular ring 48, which is anchored into the first socket 44 in substantially coaxial fashion therewith. Rod extension 46 extends short of the base wall 44*c* of the socket 44. The annular seat 40*b* formed by the free end of rod end section 40*a* radially outwardly from extension 46, comes to abut against the annular free edge 48*a* of inner ring 48. Extension 46 is shorter than the length of inner ring 48, so that its conical tip 46*a* will clear the base wall 44*c* of socket 44, opposite its free outer edge 44*d*, as clearly illustrated in FIG. 3. A handle lever 50 extends transversely through rod section 40*a* outwardly from socket 44, and is anchored welding D to rod section 40*a* at its intermediate section.

Rotation of lever 50, will reciprocate rod 40 through casing 42.

Figure 16:
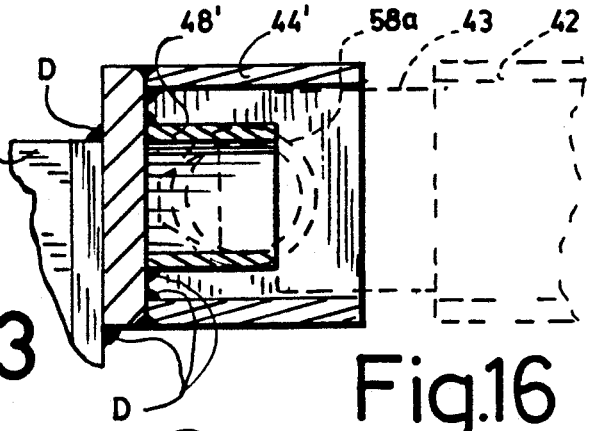
FIG. 16 is a cross-sectional view taken along lines 16—16 of FIG. 15.
Figure 15:
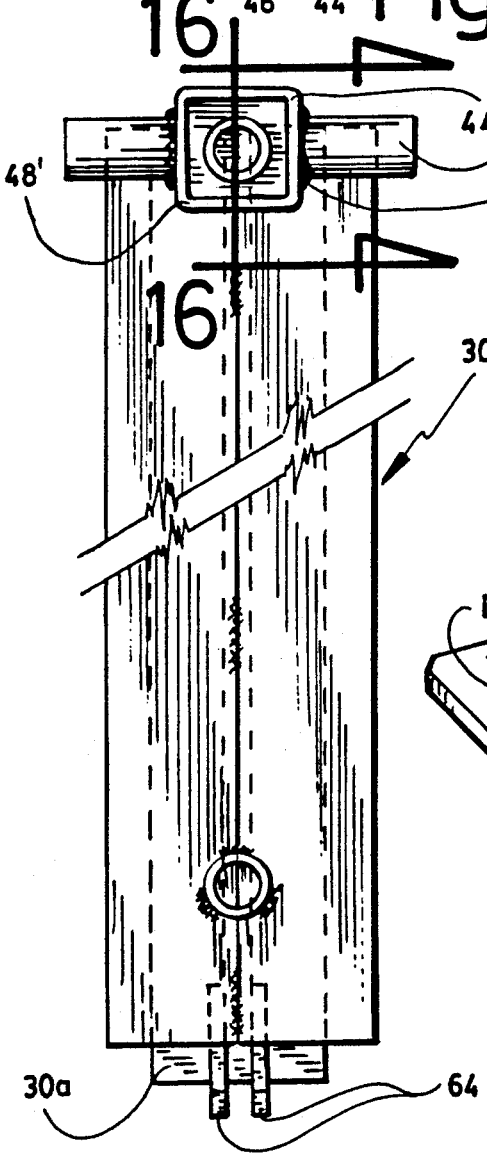
FIGS. 14–15 are front and side elevational views respectively of the wall frame element of FIG. 13.
Figure 17:
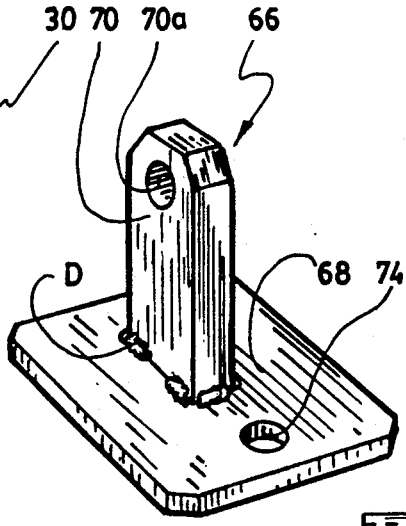
FIG. 17 is an enlarged perspective view of the supporting foot from the wall retaining system, also illustrated at the bottom of FIGS. 5 and 8.
Figure 14:
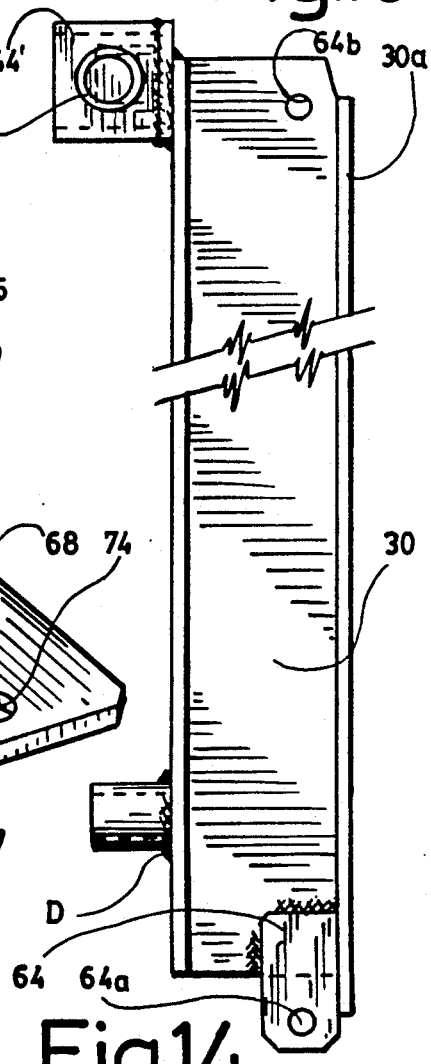

As illustrated in FIGS. 10 and 16, the opposite end of tubular casing 42 includes a diametrally smaller, cross-sectionally quadrangular extension 43 partially engaging quadrangular socket 44' anchored to an I-beam 30 on the opposite side of the threaded rod 40 of that jack member 38. Socket 44' and the inner ring 48' are similar to socket 44 and ring 48, respectively, so that the jack members can be reversed from end to end. Square socket 44 or 44', when receiving extension 43, prevents rotation of jack 38 about its longitudinal axis.

Hence, through forcible manual rotation of handle 50, rod 40 can be outwardly extended to put horizontal biasing pressure against I-beams 30, wherein the associated wooden plank wall 32 will be biased flatly vertically against the side wall 24 of earth E making the side walls of the excavation. At least a few such jack members are installed for each of the two pairs of excavation walls 24, as suggested in FIG. 2*a*.

Figure 3:
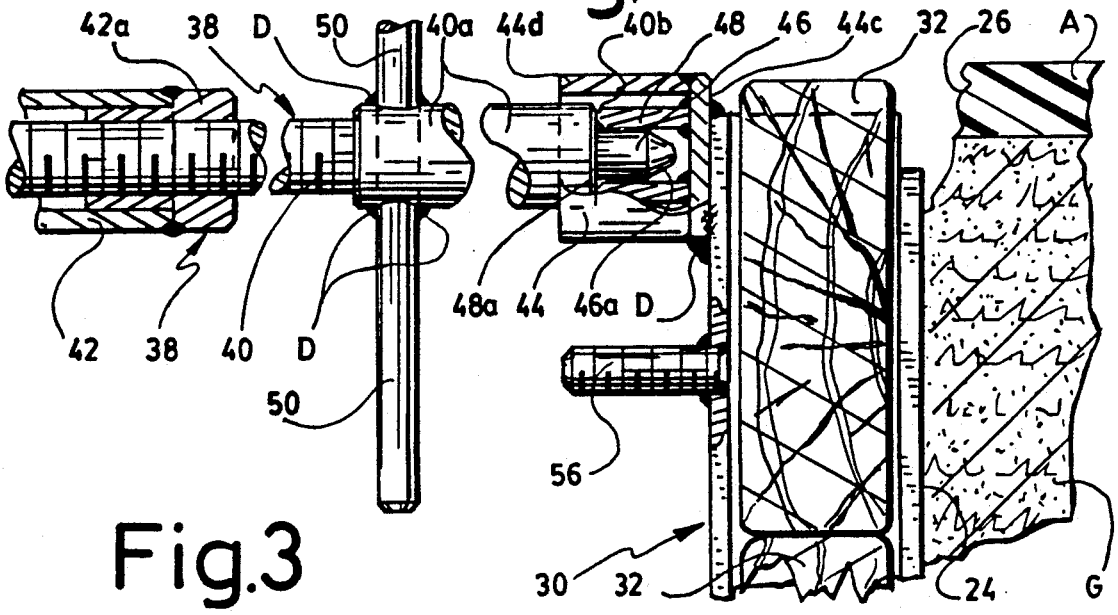
FIG. 3 is a partly broken, enlarged view of the area circumscribed by arrow 3 in FIG. 2*a;*
Figure 6:
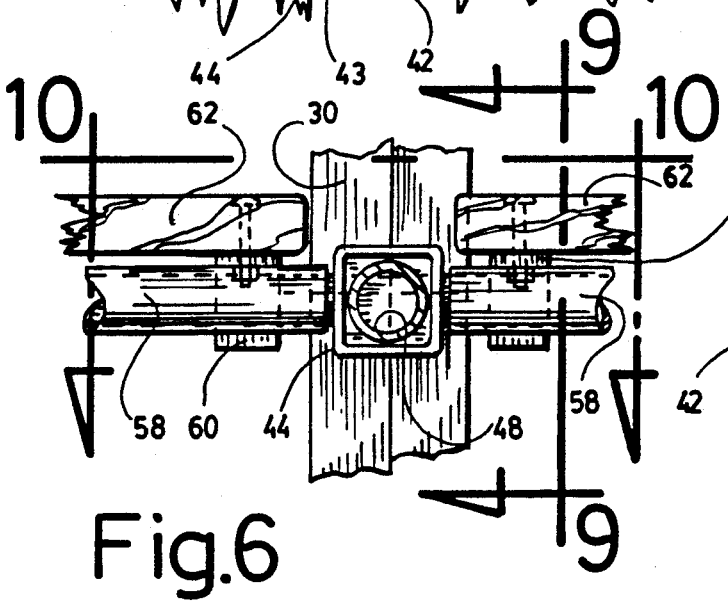
Figure 9:
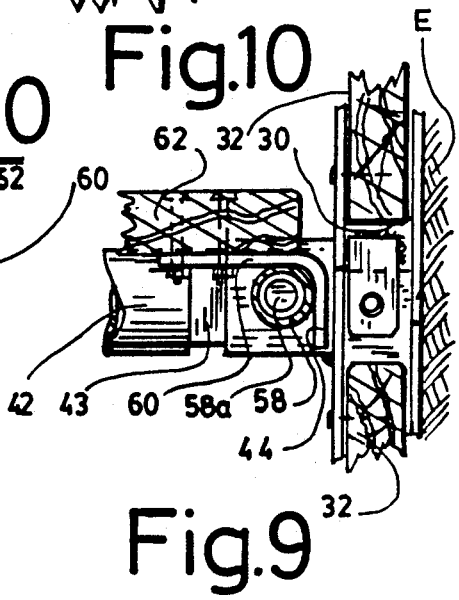

Against the inner flange 30*d* of two adjacent I-beams 30 can be releasably anchored a transverse reinforcing I-beam 54 by a bolt-and-nut assembly 56, the bolt being welded to the beam flange 30*d*, (FIG. 3). I-beam 54 is used adjacent piping P1, P2, or P3, whenever such piping prevents installation of jacks 38. A pair of oppositely-directed short cylindrical studs 58*a* are secured as by welding D to the opposite sides of each quadrangular socket 44. A tube 58 can be fitted over and supported at its ends by studs 58*a* of two adjacent beams 30. Tube 58 extends spacedly proximate and parallel to planks 32. Tube 58 can support by arcuate rigid arms 60 a horizontally-extending work-platform 62 (FIGS. 6, 9, and 10). Obviously, arms 60 are secured to and project from each end of platform 62 and hook onto a corresponding tube 58.

Platforms 62 constitute a scaffolding assembly, which is to be used above floor 22 to allow the workers to work directly in front and at the level of the damaged pipe section $P_3$ to be repaired.

Figure 4:
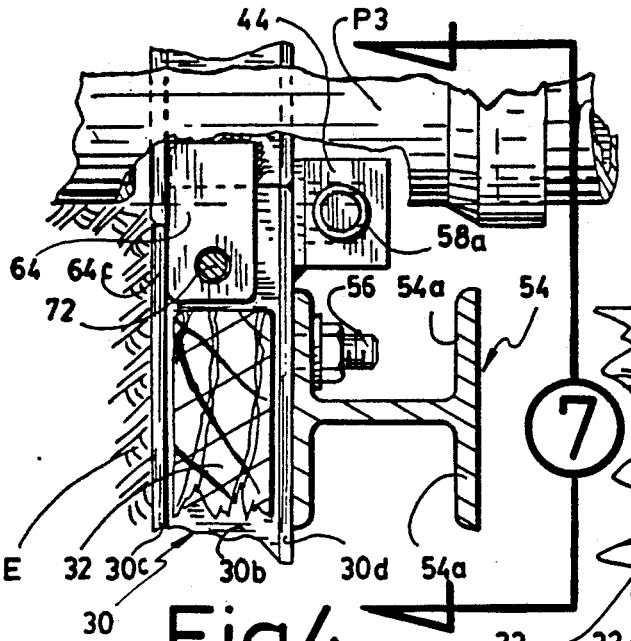
FIGS. 4–6 are enlarged view of the areas circumscribed by arrows 4–6 respectively of FIG. 2*a;*
Figure 7:
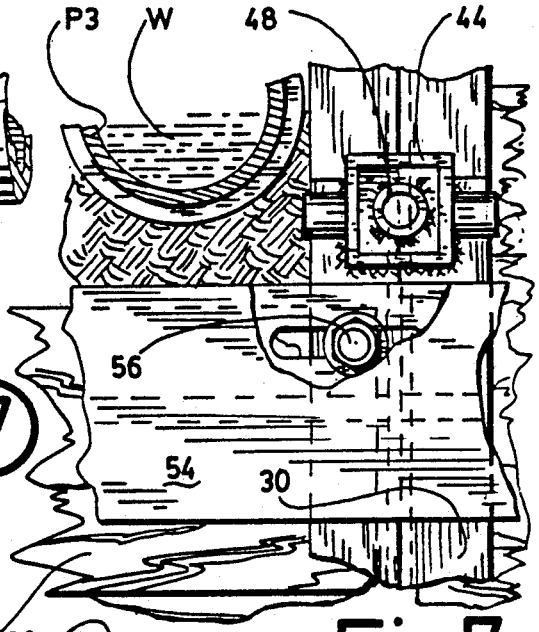
FIG. 7, on the third sheet of drawings, is a view about perspective 7 of FIG. 4.
Figure 5:
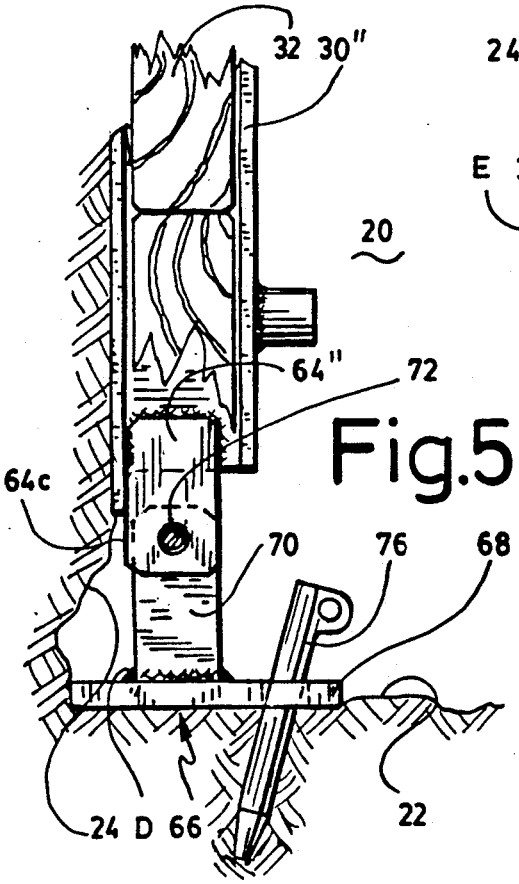
Figure 8:
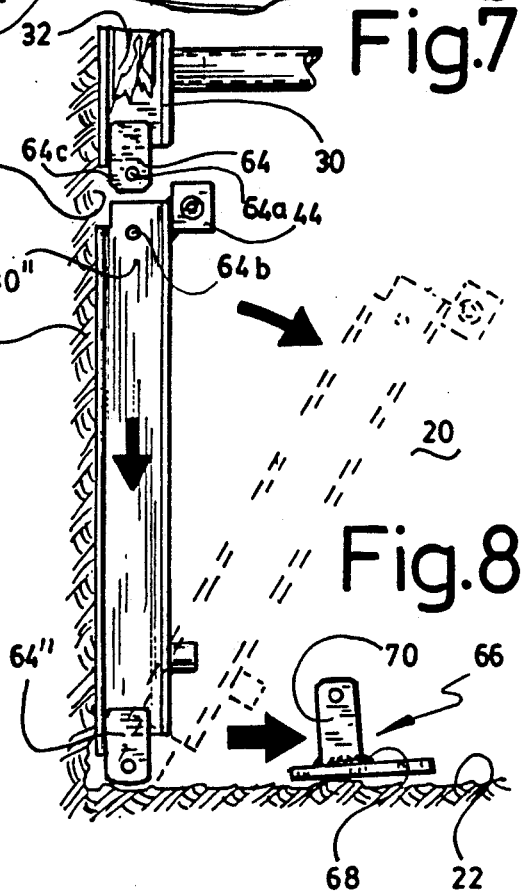
FIG. 8 is an extended view at a smaller scale of FIG. 5, showing in dotted lines how the bottom I-shape excavation support truss can be pivotally removed from the excavation.

The heart of the invention lies in the detail shown in FIGS. 4, 5, 8, 12, 14 and 17. Each I-beam 30 includes two downwardly-dependent rigid tongues 64, fixed flat to both sides of the web 30*b* of beam 30 at the bottom end thereof. Indeed, a number of vertical I-beams 30 are endwisely vertically superimposed, as shown in FIGS. 4, 5, and 8 and secured to one another at their upper and lower ends by bolts or pins 72 extending through bores 64*a* of tongues 64 and bores 64*b* at the top ends of the web 30*b* of I-beams 30. Tongues 64 straddle the web of the adjacent beam 30. The pair of tongues 64 maintain the webs 30*b* of two adjacent beams 30 in alignment, while the flanges 30*c*, 30*d* of the same beam are kept in alignment by the outer edges 64*c* of tongues 64, which overlap the top end of the outer flange 30*c* of the lower beam 30'', and by the socket 44, which forms a block protruding upwardly from the top end of the inner flange 30*d* of the adjacent lower beam 30'' and which overlaps the inner flange 30*d* of the adjacent upper beam 30 (FIG. 4). Jacks 38 are applied at the junction of two beams 30 or 30, 30''; therefore, usually no additional jacks or braces are required to brace the post sections or beams 30 except for the opposite lowermost beams where a brace 38 should be applied against a nipple 44*a* fixed to the lower end of the beams 30 (FIGS. 5 and 2*a*). The uppermost or lowermost I-beams 30 could be removed by upward or downward pulling, respectively, and so on until all the I-beams are removed. Foot members 66 [FIGS. 5, 17] are first positioned on flooring 22 and connected by bolts 72 to the tongues 64 of the lower series of I-beams, to endwisely support vertical I-beam 30'' spacedly above ground 22.

Each foot member 66 defines a large base plate 68 and a transverse arm 70. Upwardly projecting arm 70 and tongue 64 each includes an endwise through bore 70*a*, 64*a* releasably engaged by a bolt and nut assembly 72 to anchor the arm and tongue together. Base plate 68 has a transverse bore 74 for releasable engagement by a ground peg 76 for temporarily anchoring foot member 66 into the ground 22, directly in vertical register under tongue 64 of the lower series of I-beams 30''.

The method of installation of the supporting wall assembly 28 is as follows. After the excavation 20 has been dug, the feet 66 and lowermost I-beams 30'' are installed in upstanding position onto floor 22. The wooden planks 32 are then horizontally positioned to laterally support earth walls 24, by endwisely slidingly engaging the top mouth of the vertical channels 30*a* of I-beams 30'', and are stacked until the entire height (or length) of the I-beams 30'' is occupied by the wooden planks 32. The lowermost plank 32 will not fall under I-beams 30'' (laterally of feet 66), since the tongues 64, which are welded at D to I-beams 30, 30'', have substantial thickness and will each act as a seat to retain the lower plank of that level series of wall member planks and I-beams.

Upper adjacent I-beam endwise sections 30 are each vertically positioned endwisely over a corresponding lower I-beam 30'', its end tongues 64 being releasably anchored to the top of I-beam 30'' by a bolt/nut assembly 72. Again, wooden planks 32 are horizontally engaged into the top mouth of this second level of I-beams 30, to slide downwardly by their own weight along the vertical U-channels 30*a*, down to the corresponding tongues 64 which will stop them, as explained hereinabove for the lowermost I-beams 30''. The planks 32 will therefore become stacked spacedly over the planks retained by I-beams 30''. This is repeated a number of times until pavement level A is reached. If so desired, the length of planks 32 can be shortened to clear tongues 64 and thus eliminate any gap between the planks 32, as shown in FIG. 2A.

I-beams 30, 30', 30'' may be of a suitable materiel in various standard lengths.

The elongated jacks 38 are then horizontally installed to retain the beams 30, 30'' in position, the strong pressure exerted by the jacks against the walls 32 will anchor the latter to the earth wall 24; thus, when the platforms 62 will be installed to the walls 32 and workers and equipment will weight on the whole assembly 28, it is understood that the feet 66 will be substantially relieved from sustaining this weight load, due to the major contribution of the overlying jacks 38 which extend transversely of the excavation 20.

When repairs to the damaged pipes $P_3$ at the lowermost area of the excavation 20 are completed, the corresponding jack members 38 are first unscrewed and removed; thereafter, feet 66 are removed by pulling out the pegs 76, disconnecting bolts 72, sliding plates 68 away from wall 24 to clear the area under the I-beam 30''. The lower I-beams 30'' will fall by their own weight at least until their bottom, downwardly projecting tongues 64 abut the ground 22; this necessarily should clear the tongues 64 of the next adjacent upper series of I-beams 30 from the top edge section of the lower level series of I-beams 30'', wherein the latter I-beams 30'' may then be pivotally removed from wall 24 as suggested in phantom lines in FIG. 8. The wooden planks 32 from the upper I-beams 30 will not fall down because of the tongues 64, but will remain within the U-channels of the second level series of I-beams 30. The planks 32 are released from the I-beams 30'''.

Hence, every structural element of the lower section of the support wall assembly 28 is retrieved: there is nothing left behind. There is thus no waste, allowing full recovery of capital cost.

Wall assembly is preferably removable from the bottom up to permit gradual earth-billing of the excavation but it is also possible to dismantle same from top to bottom, although this is less safe because of possible landslides—a hazard to the safety of the workers still in the excavation.

I claim:

1. An excavation wall-retaining assembly for retaining the walls of an excavation during repairs of a damaged section of earth ground-embedded fluid pipes exposed in said excavation, the latter having a flooring, said wall-retaining assembly comprising:

a) a first level series of lowermost wall members, vertically installed around said excavation just above said flooring;

b) base members resting on said flooring and releasably supporting said first series of wall members spacedly above said flooring;

c) at least a second level series of upper wall members vertically installed edgewisely over said first series of wall members,; some of said first and second wall members having apertures for through passage of said fluid pipes transversely of said excavation;

d) securing means, releasably anchoring said lowermost wall members edgewisely to said second series of wall members against lateral relative displacement thereof;

e) biasing means providing releasable, adjustable, compressive biasing forces against said wall members, so as to retain the latter in vertical position to resist against caving in of surrounding earth;

said wall-retaining assembly being dismanteable and all of its structural elements being fully retrievable after use; each wall member comprising f) a number of vertically-extending spaced I-beams, defining opposite U-shaped channels; and g) rigid planks engaged into said U-shaped channels; said assembly further including:

h) horizontal support members releasably anchored to said I-beams at selected heights and spacedly above said excavation flooring, and extending spacedly proximate and sidewisely inwardly of said panels substantially parallel thereto; and i) at lease one platform assembly having edgewise arcuate hooking arms releasably engaged around said support members, said platform assembly being used as a raised planar surface for workers to be level with said damaged-fluid pipe section to be repaired.

2. An excavation wall retaining and scaffolding assembly a defined in claim 1, wherein each of said cylindrical support members includes a rigid rod, endwisely anchored to a pair of successive said structural beams, and a sleeve, mounted around said rod for free rotation thereabout.

3. An excavation wall-retaining assembly for retaining the walls of an excavation during repairs of a damaged section of earth-ground embedded fluid pipes exposed in said excavation, the latter having a flooring, said wall-retaining assembly comprising:

a) a first level series of lowermost wall members, vertically installed around said excavation just above said flooring;

b) base members resting on said flooring and releasably supporting said first series of wall members spacedly above said flooring;

c) at least a second level series of upper wall members, vertically installed edgewisely over said first series of wall members; some of said first and second wall members having apertures for through passage of said fluid pipes transversely of said excavation;

d) securing means, releasably anchoring said lowermost wall members edgewisely to said second series of wall members against lateral relative displacement thereof; and e) biasing means providing releasable, adjustable, compressible biasing forces against said wall members, so as to retain the latter in vertical position to resist against caving in of surrounding earth;

each wall member comprising:

f) a number of vertically-extending spaced, I-beams, defining opposite U-shaped channels; and g) rigid planks engaged into said U-shaped channels; wherein said securing means includes a rigid tongue, anchored to the bottom end section of each one of said I-beams of the second series of wall members and downwardly projecting therefrom, and freely extending into one U-channel of the vertically-registering I-beam of said first series of wall members, said tongue being of substantial thickness to act as a seat for supporting said planks of said second series of wall members, spacedly upwardly from said planks of said first series of wall members, wherein said planks are removable from said U-shaped channels of the I-beams solely in an upward fashion.

4. An excavation wall retaining assembly as defined in claim 3, wherein each base member includes a ground plate and a transverse upstanding leg, said ground plate being releasably anchored to the ground by peg means; further including other rigid tongues, each anchored to the bottom end section of a corresponding one of said structural beams of the first series of wall members and downwardly projecting therefrom; wherein each leg and a corresponding said other rigid tongue are fixedly releasably interconnected by bolt means.

5. An excavation wall-retaining assembly as defined in claim 1, wherein said I-beams are arranged in pairs of registering, oppositely facing I-beams within the excavation; said biasing means consisting of elongated jack members, each extending transversely through said excavation and endwisely releasably engaging one of said pairs of said I-beams, and wherein each of said jack members includes:

a) an elongated, hollow casing having a cross-sectionally quadrangular free end section and an open inwardly-threaded opposite end;

b) an elongated, threaded rod, threadedly engaged at into said open end of said elongated casing and defining a free end having a diametrically-enlarged, cylindrical threaded end section provided with a diametrically-smaller, cylindrical projection; lever means controlling rotation of said rod within said elongated casing; and c) first and second socket members anchored at the same level positions to said I-beams of said one pair, each socket member having an edgewise mouth and having a quadrangular cross-section for slidably receiving said free end section of said casing, first and second inner smaller ring members fixedly mounted within said first and second socket members respectively, said inner rings defining an annular edgewise mouth inwardly offset relative to said mouth of the associated socket member;

wherein, for each jack member, said elongated casing free end section is releasably slidably engaged into said first socket member and seating on said first ring member mouth, while said cylindrical unthreaded rod section is releasably freely rotatably engaged into said second socket member and seating against said second ring mouth with said cylindrical projection freely, rotatingly engaging into said second ring.

6. An excavation wall retaining assembly as defined in claim 5, wherein said cylindrical projection includes a conical tip alignment, further including an additional tongue fixed to said web in transverse register with said first-named tongue, the two tongues fixed to opposite faces of said web and receiving therebetween the web of an adjacent joined post section.

7. A post section for excavation sheeting in the form of an I-beam defining a web and an inner and an outer flange forming a pair of oppositely-directed sheet-receiving channels, said outer flange adapted to be positioned against an excavation face, means for interconnecting post sections in end-to-end relation, including a flat tongue secured to the web of said post section and protruding from one end of said post section, and a block fixed to said inner flange and protruding from the other end of said post section, said tongue and said web having pin-receiving bores, which register when said one end of said post section is joined to said other end of an adjacent post section; whereby, when pin means are releasably inserted through said registering bores, said tongue and block maintain the inner and outer flanges of two joined post sections in respective alignment, further including an additional tongue fixed to said web in transverse register with said first-named tongue, the two tongues fixed to opposite faces of said web and receiving therebetween the web of an adjacent joined post section.

8. A post section as defined in claim 7, wherein said block forms a socket for receiving one end of an adjustable brace.

9. A post section as defined in claim 7, in combination with a foot member consisting of a base plate to rest on the bottom of an excavation; an upstanding arm having a pin-receiving bore at its upper end and secured to said base plate at its lower end, and pin means releasably inserted through the pin-receiving bores of said tongue and arm.

* * * * *